US009970255B2

(12) United States Patent
Lugo et al.

(10) Patent No.: US 9,970,255 B2
(45) Date of Patent: May 15, 2018

(54) RELIEF WELL INJECTION SPOOL APPARATUS AND METHOD FOR KILLING A BLOWING WELL

(71) Applicants: TRENDSETTER ENGINEERING, INC., Houston, TX (US); ADD ENERGY GROUP AS, Stavanger (NO)

(72) Inventors: Mario R. Lugo, Houston, TX (US); Brett Morry, Houston, TX (US); Patrick Michael Cargol, Houston, TX (US); Ole Rygg, Stavanger (NO); Ray Tommy Oskarsen, Stavanger (NO)

(73) Assignees: TRENDSETTER ENGINEERING, INC., Houston, TX (US); ADD ENERGY GROUP AS, Stavanger (NO)

( * ) Notice: Subject to any disclaimer, the term of this patent is extended or adjusted under 35 U.S.C. 154(b) by 0 days. days.

(21) Appl. No.: 15/335,805

(22) Filed: Oct. 27, 2016

(65) Prior Publication Data

US 2017/0218719 A1 Aug. 3, 2017

Related U.S. Application Data

(60) Provisional application No. 62/290,328, filed on Feb. 2, 2016.

(51) Int. Cl.
*E21B 33/076* (2006.01)
*E21B 33/038* (2006.01)
(Continued)

(52) U.S. Cl.
CPC ..... *E21B 33/076* (2013.01); *E21B 33/038* (2013.01); *E21B 33/064* (2013.01); *E21B 34/04* (2013.01)

(58) Field of Classification Search
None
See application file for complete search history.

(56) References Cited

U.S. PATENT DOCUMENTS 3,457,991 A 7/1969 Sizer
3,643,741 A * 2/1972 Miranda ..... E21B 33/13 166/295
(Continued)

FOREIGN PATENT DOCUMENTS

EP 0709545 A2 1/2003
WO 1986002696 A1 5/1986
WO 2012174194 A2 12/2012

*Primary Examiner* — Matthew R Buck
*Assistant Examiner* — Douglas S Wood
(74) *Attorney, Agent, or Firm* — Egbert Law Offices, PLLC

(57) ABSTRACT

A relief well injection spool for use in killing a well has a body with a pair of inlets opening to a bore on an interior of the body, a ram body cooperative with the bore of the body so as to selectively open and close the bore, an upper connector affixed to the body and adapted to connect the body to a lower end of a blowout preventer, and a wellhead connector affixed to a lower end of the body. Each of the pair of inlets has a valve cooperative therewith. The upper connector opens to the bore of the body. The wellhead connector is adapted to connect to a relief well wellhead. The wellhead connector also opens to the bore of the body. A floating vessel can be provided so as to deliver a kill fluid into at least one of the pair of inlets.

6 Claims, 4 Drawing Sheets

(51) Int. Cl.

| | |
|---|---|
| ***E21B 33/064*** | (2006.01) |
| ***E21B 34/04*** | (2006.01) |
| *E21B 33/13* | (2006.01) |
| *E21B 43/01* | (2006.01) |
| *E21B 34/16* | (2006.01) |

(56) References Cited

U.S. PATENT DOCUMENTS

| | | | | |
|---|---|---|---|---|
| 4,378,849 | A | 4/1983 | Wilkes | |
| 9,057,243 | B2 | 6/2015 | Hendell et al. | |
| 9,556,722 | B2 * | 1/2017 | Elmbo | E21B 7/00 |
| 9,631,459 | B2 * | 4/2017 | Nedwed | E21B 41/0007 |
| 9,651,185 | B2 * | 5/2017 | Borgmeier | F16L 53/008 |
| 2012/0001100 | A1 * | 1/2012 | Hubbell, Jr. | E21B 33/038 251/1.1 |
| 2012/0305262 | A1 | 12/2012 | Ballard et al. | |
| 2013/0037272 | A1 * | 2/2013 | Dale | E21B 21/00 166/363 |
| 2016/0168940 | A1 * | 6/2016 | McMiles | E21B 33/064 166/363 |

* cited by examiner

RELIEF WELL INJECTION SPOOL APPARATUS AND METHOD FOR KILLING A BLOWING WELL

CROSS-REFERENCE TO RELATED APPLICATIONS

The present application claims priority from U.S. Provisional Patent Application Ser. No. 62/290,328, filed on Feb. 2, 2016, and entitled "Relief Well Injection Spool and Method of Using the Same to Kill a Well".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to well killing systems. More particularly, the present invention relates to techniques for injecting fluids into a relief well. Additionally, the present invention relates to diverter spools in association with a blowout preventer on a relief well.

2. Description of Related Art Including Information Disclosed Under 37 CFR 1.97 And 37 CFR 1.98.

Several methods can be considered to control offshore blowouts, but they can all be classified as surface interventions or relief well methods, depending on the intervention approach. Surface intervention aims to control the blowout by direct access to the wellhead or fluid exit point of the wild well. Relief wells are used to gain control of blowouts in situations where direct surface intervention is impossible or impractical. Instead, relief well methods include killing the uncontrolled well downhole from a surface location at a safe distance away from the wild well. Blowout and kill simulation studies have shown that some wells could require more than one relief well for a dynamic kill operation.

In the aftermath of the Macondo blowout in the Gulf of Mexico in 2010, the development of surface intervention methods and subsea capping systems received a great deal of focus, but a operator will recognize that drilling a relief well followed by a dynamic kill operation will, in many cases, be the safest and most likely successful well intervention. Furthermore, in some blowout scenarios, it will be the only way to regain control. It is therefore important that the operator can demonstrate the feasibility of the relief well operation on a particular well and field.

Relief wells have been drilled regularly as a last-resort well-intervention method when other surface kill efforts have failed. In the early 20th century, relief wells were spudded in close proximity to a blowout and drilled vertically to the reservoir. Subsequently, the formation must be produced at a high rate to relieve pressure, which is where the "relief well" name originates. A milestone for directional relief wells occurred in 1933 when a blowout was killed for the first time by directly intersecting the flowing wellbore. The first application of magnetic ranging to achieve a downhole well intersection was performed in 1970. This ranging technique was further refined in the 1980s, which is now the basis of modern relief-well planning.

The dynamic kill technique for relief well kill was first defined by Mobil in 1981. In 1989, a blowout occurred in the Norwegian North NCS, where the dynamic kill operation was planned using the first dynamic kill simulator named OLGA-WELL-KILL. Since then, OLGA-WELL-KILL has evolved to become the industry's leading dynamic kill simulator and has been used successfully to plan an extensive number of blowout interventions.

The dynamic kill technique has been established as the preferred method for killing a blowout after intersecting with a relief well. The dynamic kill uses the increased hydrostatic head of a mixture of gas, oil, and mud in the blowing well together with the frictional pressure drop to increase the bottomhole pressure and consequently stop the flow from the reservoir. For very prolific/hard-to-kill blowouts, the pump rate necessary to be delivered at the intersection point can be beyond what can normally be pumped from a single relief well rig. This will trigger options to optimize the capacity of the relief well for the planning of two or more relief wells.

Multiple relief wells may be planned even when the kill measurements are within the limitations of a single drilling rig. In other words, a prolific blowout results in a massive discharge of oil so as to justify a secondary relief well as a back-up in case the primary well does not meet the target. This has been the case for many historical relief-well projects during the 2010 Macondo blowout, where two relief wells were drilled, but only one relief well actually intersected the target well. In fact, the only known incident were two relief wells simultaneously intersected a blowing wellbore was used for a dynamic kill is the 1995 Le-Isba onshore blowout in Syria. There is no actual experience of intersecting and coordinating a dynamic kill in offshore environment with multiple relief wells.

A kill operation with two relief wells is recognized as being a challenging operation. Two or more drilling rigs for the specific operation must be mobilized. Each of the drilling rigs drill a relief well from an approved surface location. Furthermore, both relief wells will have to simultaneously locate and intersect the blowing wellbore. The blowing well must be killed through a simultaneous coordinated kill operation. Complex operations are, in general, more time-consuming. As a result, this will increase the total volume of oil and gas released to the environment.

As a result of the limited experience with potential challenges, the NORSOK D-010 well integrity standard states that, for offshore wells, the well design should enable killing a blowout with one relief well. If two relief wells are required, the feasibility of such an operation must be documented. An offshore well design that requires more than two relief wells is not acceptable. Similarly, other governmental agencies will not grant approval for a permit to kill an exploration well if a worst-credible blowout may require two or more relief wells for the kill operation.

If the kill requirements are excessive and a drilling permit is not granted, the planned well design can, in some cases, be revised to lower the pumping requirements within the capacity of a single relief well. Some examples include setting the last casing string deeper to allow a deeper relief-well intersect, using a smaller diameter casing to increase friction during the dynamic kill, setting additional casing strings to isolate sands, or drilling a smaller hole size to lower the flow potential of potential flowing sands. In these cases, the planned well design is driven by dynamic kill requirements. An example of this is the Chevron Wheatstone project in which additional casing strings were set to allow a deeper relief well intersect and increase friction pressure in the blowout well during a dynamic kill.

Setting additional casing strings may come at a high cost since it requires great time, introduces additional risks, and could affect production rates. In other words, well is designed for smaller casing and, as result, smaller production tubing will flow at a lower rate per well than with larger tubing sizes. This may have a significant impact on the overall field development cost increase in the number of wells required to produce at a given rate. The cost increase of a standard well design can be in on the order of $50 million per well higher than for a big-bore well.

For a blowout where a relief well intervention is the only option and the kill requirements are expected to be very demanding, alternatives to multiple relief wells can include the risk of reducing the required pumping rate, performing a staged kill with high-density kill mud followed by a later static mud, or using special or reactive kill fluids. These techniques have been used on actual project with some success, but they may introduce additional risk and complexity. For blowout contingency planning, it is a proper business practice to be conservative and to plan for a standard dynamic kill with a uniform mud and with enough pump redundancy that the kill rate can be maintained if one pump fails. Thus, increasing the pumping capacity of a single relief well will often be the best alternative than relief to multiple relief wells.

When initiating a dynamic kill for a floating rig with the wellhead at the seabed, the relief well will be shut in at the blowout preventer using the pipe rams and kill fluid will be pumped down the choke-and-kill lines to the blowout preventer at the wellhead. Depending on the water depth and the choke-and-kill line size, the flow capacity and hence the pressure drop in the choke-and-kill lines could have a significant impact on the total flow rate that can be pumped down the relief well. For a deepwater relief well pumping operation, it is therefore critical to use a drilling rig with large diameter choke-and-kill lines.

To monitor the downhole pressure during the dynamic kill operation, the drill pipe must be in the wellbore. The size and length of the bottomhole assembly and the drill pipe could influence the total pressure drop in the wellbore. If required, the drill pipe and the bottom hole assembly can be swapped just prior to drilling the last few meters before reaching the intersection. To further enhance the flow capacity in the relief well, the casing design must be evaluated. A typical relief well design would include a 9⅝ inch casing set prior to intersection with a 7 inch liner as a contingency to protect the open hole prior to the intersection point. If the 9⅝ inch casing is substituted with a liner, the flow capacity in the relief well may also increase significantly.

Pumping down both the annulus and the drill pipe simultaneously during the kill will increase the flow capacity and reduce the total pressure drop even further. This requires a pressure sensor in the bottom hole assembly to measure the dynamic pressure of well pumping to avoid fracturing operations during the kill and to know when to reduce the kill rate after the flowing bottom hole pressure exceeds the pore pressure. Performing the kill operation without downhole-pressure control is not recommended.

The methods mentioned above for increasing flow capacity may lower the required pumping pressure and hydraulic horsepower for the kill operation. However, if the required kill rate is still beyond the rig capacity, then additional pumping units must be added. Offshore drilling rigs suitable for relief well operations are required with a number of mud pumps and a cementing unit. However, if additional pump units are needed, then they must be lined up to the rigs' existing floor-space and high-pressure manifold system, which might require modification and redesign of the piping system. Additional pumps on deck also add weight and use up deck space. On many rigs, this can be a limiting factor.

To increase the pumping capacity of the relief well, a dedicated kill plant located on an independent dynamically-position support vessel will likely be preferred. The support vessel could be a drilling or workover rig, a stimulation vessel, or a floating barge with a high-pressure kill plant. To supply mud to the high-pressure pumping vessel, a large dynamically-positioned platform supply vessel with centrifugal pumps and low-pressure hoses positioned alongside the pumping vessel can be used.

To increase the pump capacity for the relief well, the dedicated kill plant on the support vessel will need to be linked together with the mud system of the relief well rig. There are three points-of-connection to be considered. These are the surface interface on the rig deck, the subsea interface with the rig equipment, and the subsea interface with a dedicated manifold located between the wellhead and the blowout preventer. The surface interface on the rig deck is a surface interface and the rig deck is a surface connection between two vessels. This is the industry operating practice to increase fluid storage and pumping capacity. Vessels are connected by high-pressure flex lines to a temporary high-pressure manifold constructed on the rig floor, which is then tied into the choke-and-kill lines. In addition to limitations of the size of the choke-and-kill lines, the flex lines need to be short enough to limit frictional losses, but long enough that wind, waves, and current would not cause the vessels to collide. The vessels would likely need to disconnect in seas of approximately four meters or greater.

In relation to the subsea interface with rig equipment, for a deep water relief well with a subsea wellhead, the kill fluid is pumped down the choke-and-kill lines to the blowout preventer and subsequently to the relief-well annulus between the wellbore in the drill pipe. The choke-and-kill lines are an integral part of the riser system, and they are connected to the blowout preventer/lower marine riser package mounted at the top of the wellhead. No additional inlets are available for pumping unless the system is redesigned and modified. One concept is to install a temporary manifold between the blowout preventer and the lower marine riser package. However, this would likely cause loss of the blowout preventer function. As such, it is considered impractical. A second concept is to cut the choke-and-kill lines on one of the riser elements and retrofit a Y-branch joint the can be used as a tie-in point for the flex lines from the support vessels. This would need to require the entire riser to be pulled to the surface (which would be time-consuming) or a second rig with a different riser system would need to be mobilized. Furthermore, with a Y-branch welded to the side of a riser element, the assembly might not fit through the rig rotary due to its external dimensions. Instead, the riser element would be deployed to the side and subsequently moved underneath the rig to be connected with the riser. A subsea interface with existing rig equipment would require modifications to suite-specific riser types and each individual blowout preventer/lower marine riser package interface. In the event of a blowout disaster, a solution that calls for major on-the-fly modifications to tailor-made equipment would add significant risks to the operation or would likely be disapproved by rig contractors, regulatory agents, and other stakeholders.

In relation to the subsea interface with a dedicated manifold located between the wellhead and the blowout preventer, it is believed that a dedicated manifold with flow line connector is located between the wellhead in the blowout preventer would be the preferred and advantageous solution. As such, the present invention was developed so as to achieve such a configuration.

In the past, various patents have issued relating to techniques for controlling downhole pressures and for containing fluids. For example, U.S. Pat. No. 9,057,243, issued on Jun. 16, 2015, to Hendell et al., discloses an enhanced hydrocarbon well blowout protection system. The protection at a hydrocarbon well is enhanced by placing a blowout preventer over a wellhead. An adapter is connected to the blowout preventer. The adapter includes a valve that, when turned off, prevents non-production flow from the blowout preventer to a riser pipe.

U.S. Pat. No. 4,378,849, issued on Apr. 5, 1983, to J. A. Wilkes, teaches a blowout preventer having an mechanically-operated relief valve. The blowout preventer has a mechanical linkage to a valve connected to a pressure relief line in the casing beneath the blowout preventer whereby the valve on the pressure relief line is opened when the blowout preventer is actuated. The blowout preventer includes an upright tubular body having an annular packing therein which can be constructed about a drill pipe or other pipe in the well, a head connected to the top of the upright tubular body for containing the annular packing in the body, a piston slidably received in the body and adapted to selectively constrict the packing about the well pipe, a casing pipe connected to the lower end of the body for containing the well pipe, a pressure relief line connected to the casing having a valve therein, and a rod connected to the piston and the valve to open the valve when the piston slides within the tubular body to constrict the packing about the well pipe.

U.S. Pat. No. 3,457,991, issued on Jul. 29, 1969 to P. S. Sizer, discloses a well control flow assembly which includes a plurality of blowout preventers and an automatic subsurface safety valve positioned in the blowout preventers. The valve is biased to a closed position and is moved to an open position by pressure fluid which is controlled by means positioned at the surface of the well. One object of this invention is to provide a new and improved flow control assembly which is installable in the well during the drilling of the well. It is held in place in the well installation by blowout preventers used in the drilling of the well. It is provided with a valve located below the blowout preventers which may be controlled from the surface for controlling flow from the well.

U.S. Patent Application Publication No. 2012/0305262, published on Dec. 6, 2012, to Ballard et al., shows a subsea pressure relief device. This device serves to relieve pressure and a subsea component. The device includes a housing included including an inner cavity, and open end in fluid communication with the inner cavity, and a through bore extending from the inner cavity to an outer surface of the housing. The device has a connector coupled to the open end. The connector is configured to releasably engage a mating connector coupled to the subsea component. The device further includes a burst disc assembly mounted to the housing within the through bore. The burst disc assembly is configured to rupture at a predetermined differential pressure between the inner cavity in the environment outside the housing.

U.S. Patent Application Publication No. 2012/0001100, published on Jan. 5, 2012 to P. J. Hubbell, discloses a blowout preventer-backup safety system. The system serves to address the problem of having a failed blowout preventer. This provides an independent backup safety system when encountering an oil/gas well "kick" or blowout and is not reliable in any of the complex, multiple components of the blowout preventer. The system includes a double manifold, double bypass device which is a supplemental connection between the wellhead in the inlet of the blowout preventer that allows for relief for both temporary and/or extended time. Until repairs, replacements, or capping procedures are complete.

European Patent No. 0709545, published the Jan. 15, 2003 to S. Gleditsch, teaches a deep water slim hole drilling system. The system relates to an arrangement used for drilling oil or gas wells, especially deep water wells. This system provides instructions for how to utilize the riser pipe as part of the high-pressure system together with the drilling pipe. The arrangement comprises a surface blowout preventer which is connected to a high-pressure riser pipe which input, in turn, is connected to a well blowout preventer. A circulation/kill line communicates between the blowout preventers.

International Publication No. WO 2012174194 in the name of the present applicant discloses a diverter system for a subsea well which has a blowout preventer and a diverter affixed to an outlet of the blowout preventer. The blowout preventer has an interior passageway with an inlet at the bottom thereof and an outlet at the top thereof. The diverter has a flow passageway extending therethrough and in communication with the interior passageway of the blowout preventer. The diverter has a valve therein for changing a flow rate of a fluid flowing through the flow passageway. The diverter has at least one channel opening in valved relation to the flow passageway so as to allow fluid from the flow passageway to pass outwardly of the diverter. At least one flow line is in valved communication with the flow passageway so as to allow fluids or materials to be introduced into the flow passageway.

International Publication No. WO1986002696, published on May 9, 1986, to J. R. Roche, shows a marine riser well control method and apparatus. This method and apparatus serves to maintain safe pressure in the annulus of a deepwater marine riser by preventing the displacement of drilling mud with formation gas. By providing an improved flow diverting control device having an annular sealing device in the riser string below the riser telescopic joint, liquid well fluids under limited pressure can be maintained in the riser despite the impetus of formation gas below the mud column to displace the liquid. The provision of an annular shut-off below the telescopic joint eliminates the necessity to seal well fluid pressure at the telescopic joint packer during kick control circulating operations. The flow diverting control device includes an outlet which opens on the opening of the annular sealing device and which provides a flow path beneath the annular sealing device to a choke lined to facilitate bringing the well under control by circulating kill mud. If the blowout preventer stack is on the bottom, circulation can be directed down a riser kill line in introduced into the annudus above a closed ram. If the blowout preventer is open or if the stack is not on the bottom, circulation is directed down the drill pipe, up the riser annulus and through a choke manifold. By maintaining a mud column in the riser annulus, the hazard of collapsing the pipe by an external hydrostatic head near the lower end of a deepwater marine riser is avoided.

It is an object of the present invention to provide a relief well injection spool that enhances cost savings by eliminating casing strings on weld trip designs driven by dynamic-kill requirements.

It is another object of the present invention provide a relief well injection spool that moves the additional mud and pump storage challenges from the rig to remotely-located support vessels.

It is another object the present invention provide a relief well injection spool that allows the support vessels to wait to mobilize closer to the time of the relief-well intersection.

It is another object of the present invention to provide a relief well injection spool which allows the loading of the kill fluid to be performed at an onshore terminal while the relief well is being drilled.

It is another object of the present invention to provide a relief well injection spool that eliminates the necessity of installing pumps and storage tanks on the relief well rig.

It is another object of the present invention to provide a relief well injection spool that eliminates the use of boats or ships in close proximity to the relief well.

It is still another object of the present invention to provide a relief well injection spool that enhances the safety of personnel on the relief well rig and on the boats or ships during operation.

It is still further object the present invention to provide a relief well injection spool that is independent of the relief well rig and equipment.

It is another object of the present invention to provide a relief well injection spool that allows any rig to be chosen for the relief well operation.

It is still further object of the present invention to provide a relief well injection spool which can be mobilized in a minimal amount of time.

It is still a further object of the present invention to provide a relief well injection spool that enhances well design and oil spill contingency plans.

It is still a further object the present invention provide a relief well injection spool which allows a potential worst-case blowout scenario to be killed with a single relief well.

These and other objects and advantages of the present invention will become apparent from a reading of the attached specification and appended claims.

BRIEF SUMMARY OF THE INVENTION

The present invention is a relief well injection spool apparatus that comprises a body having a pair of inlets opening to a bore on an interior of the body, a ram body cooperative with the bore of the body, and upper connector affixed to the body and adapted to connect the body to a lower end of a blowout preventer, and a wellhead connector affixed to a lower end of the body. Each of the pair of inlets has a valve cooperative therewith. The ram body is selectively movable so as to open and close the bore. The upper connector opens to the bore of the body. The wellhead connector is adapted to connect to a relief well. The wellhead connector opens to the bore of the body.

The pair of inlets are positioned on diametrically opposed locations on the body. In particular, the valve for each of the inlets includes a first valve cooperative at the inlet so as to selectively open and close the inlet, and a second valve position in spaced relation to the first valve and cooperative with the inlet so as to selectively open and close the inlet. Each of the first and second valves is actuatable by a remotely-operated vehicle.

The relief well injection spool of the present invention further includes a first line having one end connected to one of the pair of inlets and extending to a surface location. The first line is adapted to pass a kill fluid to one of the pair of inlets. A floating vessel can be connected to an opposite end of the first line. The floating vessel has a fluid storage tank and a pump thereon. A second line is connected to the other of the pair of inlets. The second line also extends to a surface location and can also be connected to another vessel.

The relief well injection spool apparatus of the present invention further includes a blowout preventer affixed to the upper connector, a relief well drilling system located at the surface location, and a pipe extending from the relief well drilling system to the blowout preventer. A drill pipe can be connected or interconnected to the wellhead connector. This drill pipe extends to a primary well so as to connect to the primary well at a location below the seafloor.

The present invention is also a well killing system for killing a primary well in which the primary well has a wellbore extending to a producing reservoir. The well killing system includes a relief wellbore extending through a seabed so as to open to the primary wellbore, a relief well injection spool affixed to the relief wellhead, a blowout preventer affixed to an end of the relief well injection spool opposite the relief wellhead, and a kill line connected to one of the pair of inlets of the relief well injection spool. The kill line is adapted to pass a kill fluid into the relief well injection spool. The relief well injection spool has a body having an internal bore and a pair of inlets opening to the internal bore. Each of the pair of inlets has at least one valve thereon so as to selectively open and close the inlet. The relief well injection spool also has a ram body cooperative with the internal bore. The ram body is adapted to selectively open and close the internal bore of the relief well injection spool.

A floating vessel is connected to the kill line. The floating vessel has a storage tank for the kill fluid in the pump for passing the kill fluid under pressure through the kill line. The kill line includes a first kill line connected to one of the pair of inlets and a second kill line connected to another of the pair of inlets. The floating vessel includes a first floating vessel connected to the first kill line so as to pass the kill fluid to one of the pair of inlets and a second floating vessel connected to the second kill line so as to pass the kill fluid to another of the pair of inlets. A relief well drilling system is connected by pipe to the blowout preventer at an end of the blowout preventer opposite the relief well injection system.

In another embodiment, a manifold can be connected by the kill line to one of the pair of inlets of the relief well injection system. The manifold have the kill fluid therein. The floating vessel is connected by line to the manifold. The floating vessel has a storage tank for the kill fluid and the pump for passing the kill fluid through the line to the manifold. The manifold is positioned at or adjacent to the seafloor.

The present invention is also a method for killing a well that includes the steps of: (1) forming a primary wellbore to a producing reservoir; (2) forming a relief wellbore extending so as to open to the primary wellbore; (3) affixing a relief well injection spool to a wellhead of the relief wellbore in which the relief well injection spool has a pair of valved inlets extending to a bore of the spool; (4) injecting a kill fluid into the pair of inlets; and (5) flowing the kill fluid through the bore of the relief well injection spool, through the relief bore, and into the primary wellbore.

The method further includes moving a floating vessel to a surface location above the relief well injection spool. The floating vessel has a storage tank for the kill fluid and a pump for passing the kill fluid under pressure from the storage tank. The floating vessel is connected to a line that extends to one of the pair of inlets. The kill fluid is pumped under pressure from the storage tank to the inlet. The kill fluid is also pumped into the primary wellbore at a pressure greater than a pressure fluid flowing through the primary wellbore.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
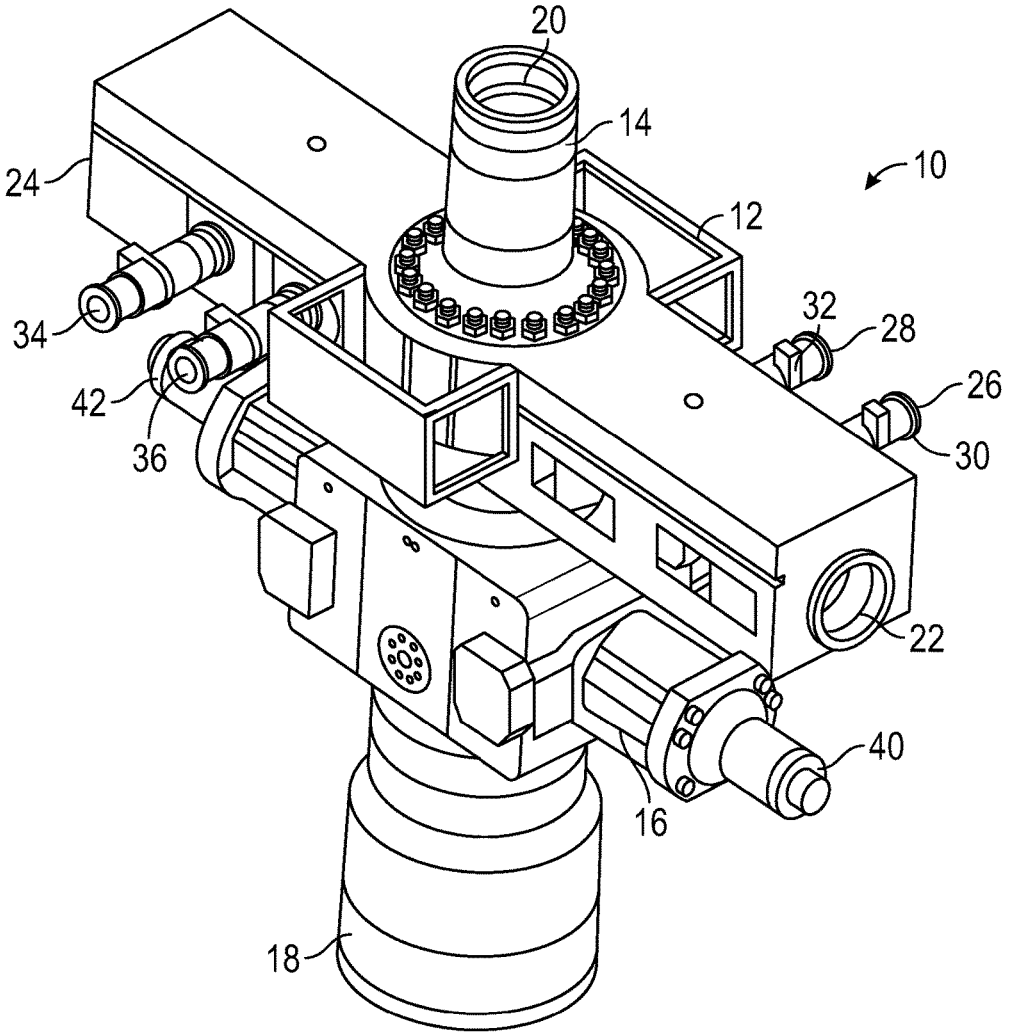
FIG. 1 is a perspective view of the relief well injection spool of the present invention.

Referring to FIG. 1, there is shown the relief well injection spool 10 in accordance with the present invention. The relief well injection spool 10 includes a diverter inlet spool 12, an upper mandrel 14, a ram body 16, and a wellhead connector 18. The upper mandrel 14 is affixed to the upper side of the diverter inlet spool 12. The ram body 16 is affixed to an lower end of the diverter inlet spool 12 opposite the upper mandrel 14. The wellhead connector 18 is affixed to a lower end of the ram body 16 opposite the diverter inlet spool 12. The wellhead connector 18 is configured so as to connect to the relief well wellhead.

The diverter inlet spool 12 is configured so as to allow kill fluids to be introduced into the internal bore 20 extending through the diverter inlet spool 12, the ram body 16 and through the wellhead connector 18. In particular, the diverter inlet spool 12 includes a first inlet 22 and a second inlet 24 (not shown in FIG. 1). These inlets 22 and 24 will extend through the body of the diverter inlet spool 12 so as to have an inner end opening to the bore 20. The inlets 22 and 24 will have a diameter typically of 4 1/16 inches. A pair of valves 26 and 28 are configured so as to cooperate with the inlet 22. Valves 26 and 28 are isolation valves that are independently actuatable. The valves 26 and 28 are arranged in spaced relationship. The valve 26 includes a bucket 30. The valve 28 includes a bucket 32. Buckets 30 and 32 are configured so as to allow an actuator associated with an ROV to be used so as to open and close the valves, as required. As such, when the valves 26 and 28 are closed, then the kill fluid cannot flow through the inlet 22.

The inlet 24 has valves 34 and 36 cooperative therewith. The valves 34 and 36 are configured in the same manner as valves 26 and 28 associated with inlet 22. Valves 34 and 36 include ROV-receiving buckets thereon. Valves 34 and 36 are also isolation valves that are operable so as to open and close the inlet 24 so as to selectively allow the flow of a kill fluid therein. Inlets 22 and 24 are diametrically opposed on the diverter inlet spool. Suitable fluid lines can be connected thereto so as to deliver the kill fluid from a pumping vessel.

The mandrel 14 is affixed to the upper side of the diverter inlet spool 12. The upper mandrel 18 is configured so as to connect to the bottom of a blowout preventer. The bore 20 will have the same diameter as that of the blowout preventer. This diameter is approximately 18¾ inches.

The ram body 16 is affixed to the lower end of the diverter inlet spool 12. The ram body 16 includes selectively actuatable rams 40 and 42. These rams 40 and 42, when actuated, can extend across the bore 20 so as to seal the bore. Each of the rams 40 and 42 can have an ROV backup function.

Figure 2:
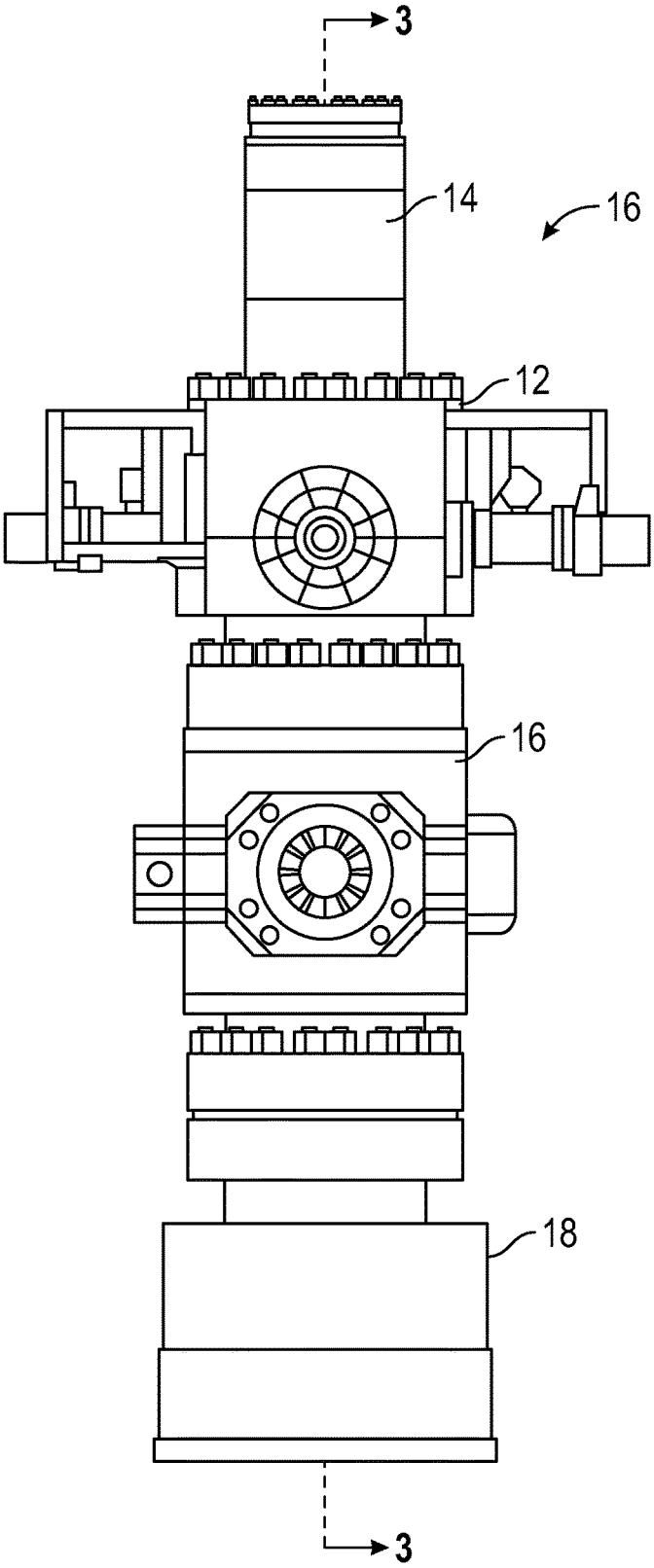
FIG. 2 is a side elevational view of the relief well injection spool of the present invention.

FIG. 2 is a side view of the relief well injection spool 10. In FIG. 2, it can be seen that the mandrel 14 is located at the upper end of the diverter inlet spool 12. The ram body 16 is positioned below the diverter inlet spool 12. Ultimately, the wellhead connector 18 is affixed by flanges to the bottom of the ram body 16.

Figure 3:
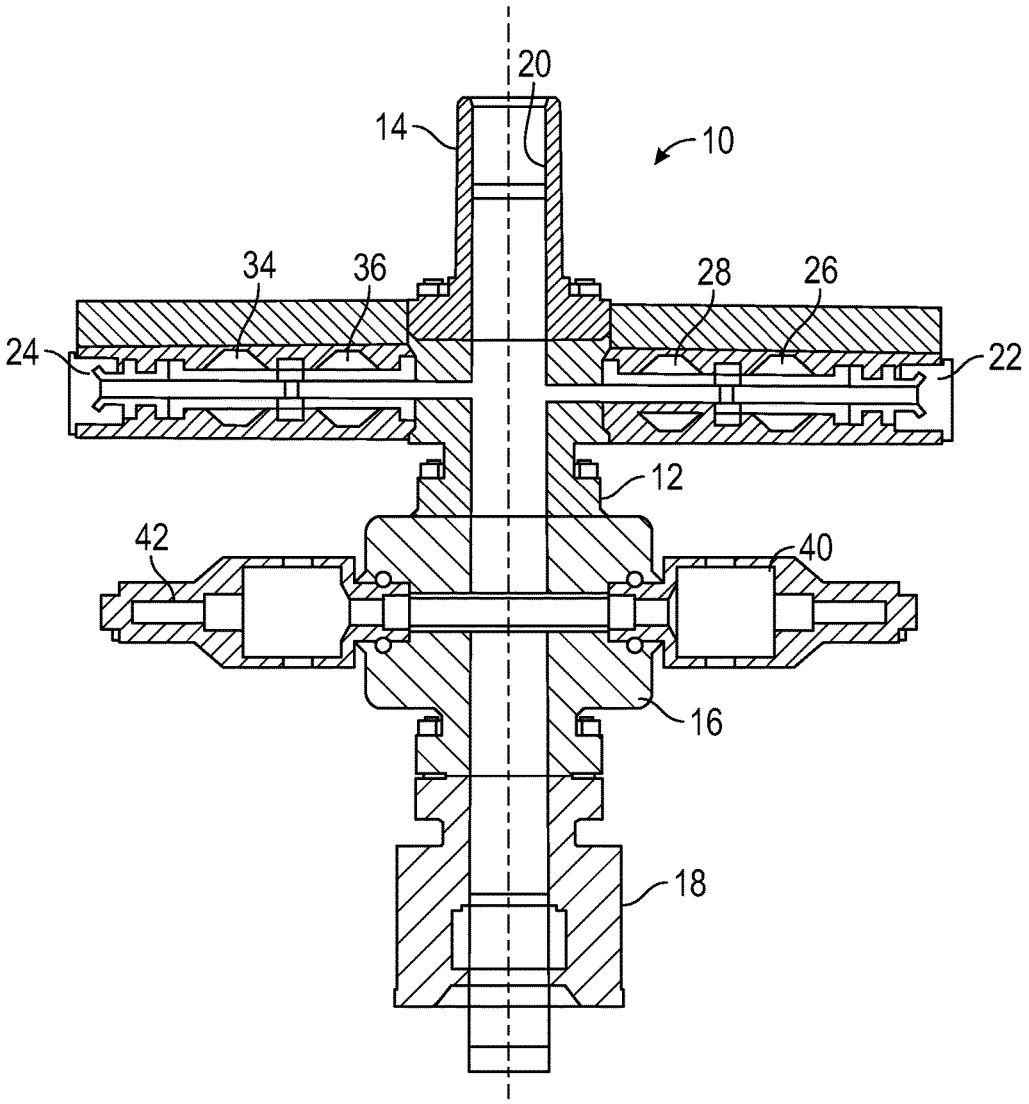
FIG. 3 is a cross-sectional view of the relief well injection spool of the present invention is taken across lines 3-3 of FIG. 2.

FIG. 3 illustrates a cross-sectional view of the relief well injection spool 10. As can be seen, the bore 20 will extend from the upper mandrel 14, through the diverter inlet spool 12, through the ram body 16, and through the wellhead connector 18. The inlets 22 and 24 are associated with a channel that opens to the bore 20. The valves 26 and 28 will communicate with the channel extending from the inlet 22. Similarly, the valves 34 and 36 will cooperate so as to act upon the channel associated with the inlet 24. It can further be seen that each of the inlets 22 and 24 includes a connector which allows the kill lines to be connected thereto.

Figure 4:
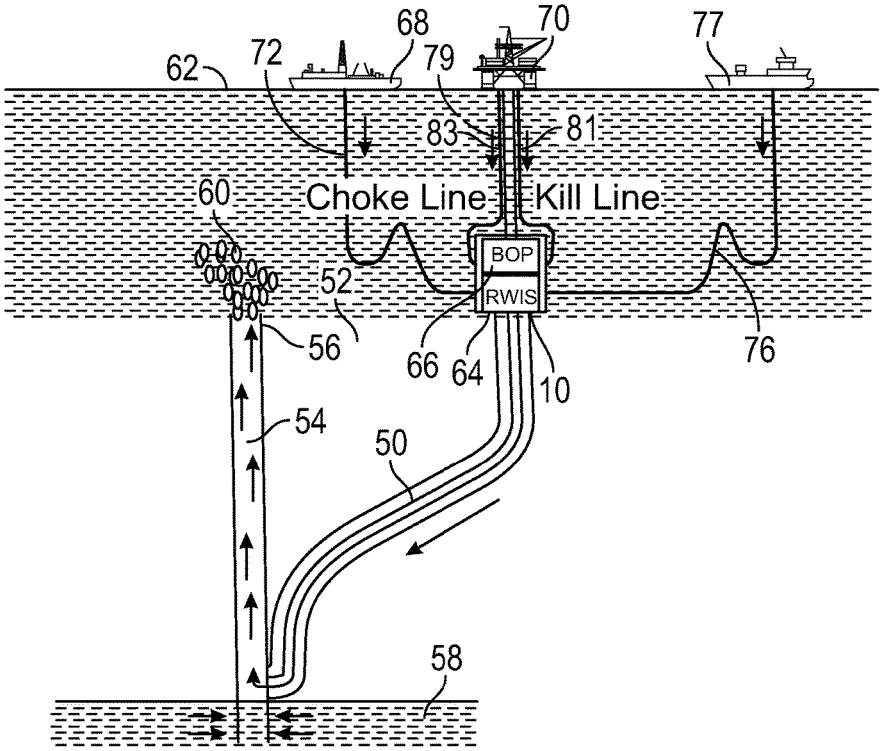
FIG. 4 is a diagrammatic illustration of the method of killing a well in accordance with the present invention.

When the kill fluid enters each of the inlets 22 and 24 and flows toward the bore 20, the blowout preventer (mounted upon the mandrel 14) will block upward fluid flow. As such, the kill fluids will flow downwardly in the bore 20 within the ram body 16. The fluids will then flow downwardly through the bore, through the wellhead connector 18 and outwardly into the relief wellbore 15 (as shown in FIG. 4). The ram body 16 is illustrated as having rams 40 and 42 cooperative therewith. The rams 40 and 42 can operate so as to close the bore 20, if desired.

FIG. 4 shows the use of the relief well injection spool 10 in association with a relief wellbore 50. In FIG. 2, it can be seen that the relief wellbore 50 extends through the seabed 52 so as to communicate with a primary wellbore 54. Primary wellbore 54 will extend from a wellhead 56 to a producing reservoir 58.

In the case shown in FIG. 4, the wellhead 56 has hydrocarbons 60 gushing therefrom. Hydrocarbons 60 will eventually flow toward the surface 62 of the body of water. As such, the present invention is implemented in those cases when such hydrocarbons 60 cannot be conventionally controlled.

The relief wellbore 50 is directly drilled through the seabed 52 so as to have one end opening to the primary wellbore 54. The relief wellbore 50 has a relief well wellhead 64 at the seabed 52. It can be seen that the relief well injection spool 10 is affixed to the relief wellhead 64. A blowout preventer 66 is then attached to the mandrel 14 of the relief well injection spool 10.

So as to allow for a kill fluid to pass through the relief well injection spool 10, through the relief wellhead 64 and into the relief wellbore 50, a pumping vessel 68 is provided adjacent to the relief well drilling system 70. The pumping vessel 68 has a storage tank with the kill fluid therein. The pumping vessel 68 can also include a pump which is cooperative with the kill fluid in the storage tank so as to transfer the kill fluid from the pumping vessel 68 under pressure to the line 72. The line 72 will extend so as to connect with one of the inlets of the diverter inlet spool 12 of the relief well injection spool 10. Another line 76 can extend from another pumping vessel 77 and connect with the other inlet of the diverter inlet spool 12. Alternatively, each of the lines 72 and 76 can extend from the pumping vessel 68 so as to deliver the kill fluid into the relief well injection spool 10 and, ultimately, into the primary wellbore 54 for the purposes of killing the well. The inlets 22 and 24 of the diverter inlet spool 12 are capable of allowing 200 barrels per minute of 2.0 specific gravity mud to be introduced into the relief wellbore 50. As stated hereinabove, when the hydrostatic pressure of the mud within the relief wellbore exceeds the pressure of the producing reservoir 58, the primary wellbore 54 is effectively killed.

In FIG. 4, it can be seen that there is a pipe 79 which extends from the relief well drilling system 10 to the top of the blowout preventer 66. A kill line 81 will extend from the relief well drilling system 70 and connect with the kill line inlet of the blowout preventer 66. A choke line 83 also extends from the relief well drilling system 70 so as to connect with a choke line inlet of the blowout preventer.

The relief well injection system 10 is a device that greatly increases the pumping capacity of a single relief well. The relief well injection system is installed on the relief well wellhead 64 beneath the blowout preventer 66 to provide additional flow connections into the wellbore 50. Using high-pressure flex lines, the inlets enable pumping units from the floating vessels 68 and 77, in addition to the relief well rig 70, to deliver a high-rate dynamic kill through a single relief well.

The relief well injection system 10 is designed with only components that are already used in proven in deepwater environments. The design is also relatively lightweight and modular. This allows the relief well injection system 10 to be transported on land, offshore, and by air freight.

The relief well injection system 10 performs the following basic functions: (1) connect and sealed to an 18¾ inch/15,000 p.s.i. wellhead housing; (2) provide an 18¾ inch/15,000 p.s.i. connection to the standard subsea blowout preventer 66; (3) provide one additional blowout preventer ram capable of shearing and sealing off the wellbore at 15,000 p.s.i. wellbore pressure when manually actuated (with a remotely-operated vehicle) via a remote subsea accumulator module; and (4) provide two subsea 4 inch horizontal flow line connectors for contingency bore access above the ram in a spool that can be opened or isolated from the wellbore by a pair of valves manually via a remotely operated vehicle.

In the in event of a blowout, relief well drilling should commence immediately as soon as a suitable rig 70 has been identified and mobilized. While the relief well is drilled, the relief well injection spool can be transported to the location. Preferably, the relief well injection spool 10 is installed prior to the blowout preventer 66, but this is not a requirement. Using downhole ranging techniques, the relief well task force locates the blowing well and directionally steers the wellbore 50 until it is finally aligned to intersect the blowing well at a planned depth. At this point, the kill-string casing will be run and cemented in place. If the relief well injection spool is not already installed, the relief well blowout preventer 66 should be disconnected from the wellhead and the relief well injection spool stack installed on the same wellhead. Subsequently, the blowout preventer 66 is reconnected on top of the relief well injection spool 10 and the flex lines 72 and 76 from the support vessels 68 and 77 are attached to the relief well injection spool inlets 22 and 24 using a remotely operated vehicle. After assembling the entire dynamic-kill pumping system, the relief well controls the final section and intersect the blowout well. Finally, a high-rate dynamic kill is achieved by simultaneously pumping down the relief well rig 70 and the support vessel 68 and 77 through the relief well injection spool 10.

As an example of a challenging dynamic kill in an offshore environment, the relief well drilled for the 2009 Montara blowout used a combination of the mud and cementing pumps of the rig to achieve a peak kill rate of sixty-eight barrels per minute. In a deep water environment, feasibility studies have shown that, in some cases, a kill rate approximately 100 barrels per minute may be achievable for a single relief well, depending on the available vessel/equipment and the blowout scenario. With current technology, a dynamic kill with a pump rate of 200 barrels per minute is considered far beyond the capability of a single relief well. FIG. 4 actually shows how the relief well injection spool 10, along with the vessels 68 and 77, can actually achieve this desired kill rate.

With reference to FIG. 4, the total pump rate required at the intersection between the relief wellbore 50 and the primary wellbore 54 is 200 barrels per minute. 40 barrels per matter pumped from the relief well rig 70 down the annulus. 20 barrels per matter pumped from the relief well 70 through the drill pipe 79. The flex line system made of line 72 and 76 extend from the vessels 68 and 77, respectively to the relief well injection spool 10. The surface distance from the support vessels 68 and 77 to the relief well rig 70 is for 500 meters. A 9⅝ inch casing is set prior to the intersection. There is a 5 inch drill pipe in the relief well 50. The maximum achievable pump pressure from the pumps within the vessel 68 and 77 is 550 bar.

Hydraulic simulations using OLGA-WELL-KILL were carried out for a blowout in 370 meters of water with a 1.2 specific gravity pressure reservoir at 1300 meters true-vertical depth. In this example, the relief well is assumed to intersect at approximately 1290 meters of true-vertical depth, just below the target/blowout well's 9⅝ inch casing shoe. It is assumed that the choke-and-kill lines are four inch lines and the flex lines connected to the relief well injection spool 10 has a five inch diameter. Based on a typical relief well designed with 9⅝ inch casings that just prior to intersecting, dynamic kill simulations with a 1.5 specific gravity mud indicate that a combined pump rate of 200 barrels per minute down a single relief well using the relief well injection spool 10 is unachievable. That is, the pump pressure for the kill plants located on the relief well rig 70 and each of the support vessel 68 and 77 will exceed 1000 bar. However, if only one of the support vessels is used for the dynamic kill, the pump pressure will be less than 500 bar on each kill plant (approximately 11,500 horsepower on the support vessel). Hence, with a typical relief well design, the maximum achievable kill rate is 130 barrels per minute using the relief well injection spool 10.

Figure 5:
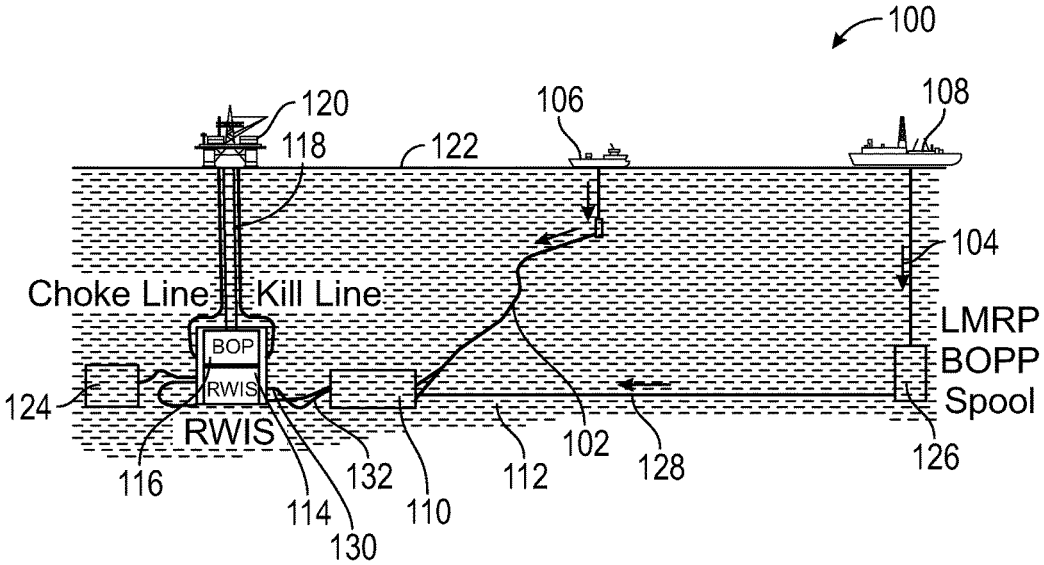
FIG. 5 is a diagrammatic illustration showing a method of killing a well in accordance with an alternative embodiment of the present invention.

FIG. 5 shows a system 100 that is able to achieve the required 200 barrels per minute kill rate. The relief well design will need, in this case, to be optimized. In order to use larger flex lines 102 and 104 from the vessels 106 and 108, respectively, a manifold 110 is placed on the seafloor 112 next to the relief well injection spool 114. It can be seen that the blowout preventer 116 is connected by a pipe 18 to the relief well rig 120 located on the surface 122 of the body of water. A control unit 124 is connected to the relief well injection spool 114 so as to control the operation of the valves allow for the cooperation with the manifold 110. The flex line 114 can flow by way of a lower marine riser package 126. Alternatively, it can flow from pipe 104 into a blowout preventer or to another spool. A flexible flow line 128 can then extend from the lower marine riser package 126 to the manifold 110. The manifold 110 has lines 130 and 132 that are connected to the separate inlets of the relief well injection spool 114.

In this case, the simulation results indicate that the pressure and the horsepower were achievable for all the kill plants. The maximum pressure and horsepower requirements are on the support vessel kill plants, with 300 bar and 7600 horsepower, respectively. Therefore, a 200 barrel per minute dynamic kill is feasible for a shallow water blowout, if the relief well design is optimized and the relief well injection spool 114 is used.

Similar to the shallow water blowout example, hydraulic simulations were done for a deep water blowout having a water depth of 1500 meters with 1.2 specific gravity and the pressure reservoir at 5500 meters of true vertical depth. In this case, it was assumed the relief well would intersect at approximately 5450 meters of true vertical depth. This would be just below the 14 inch casing shoe of the blowing well. A 1.75 specific gravity kill mud, in this case, is necessary to bring the well to static conditions. With a typical relief well design (e.g. 9⅝ inch casings set just prior to intersecting), the maximum achievable combined pump rate is 90 barrels per minute (i.e. 20 barrels per minute down the five inch drill pipe, 30 barrels per minute down the four inch choke-and-kill lines, and 40 barrels per minute through the five inch flex lines from each of the support vessels).

As in the previous example, to achieve the required 200 barrel per minute kill rate, the relief well will need to be optimized with 4.5 inch choke-and-kill lines, six inch flex lines, and a 14 inch casing plus 300 meters of 9⅝ inch liner. The maximum pressure and horsepower requirements are on the support vessel kill plants with 325 bars and 8080 horsepower, respectively. Again, a 200 barrel per minute dynamic kill is also feasible for a deep water blowout if the relief well design is optimized and the relief well injection spool is utilized.

From the analysis of the relief well injection spool, it was found that the relief well injection spool of the present invention is able to achieve significant benefits over prior offshore blowout control attempts. The relief well injection system can provide cost savings by eliminating casing strings on well designs driven by dynamic-kill requirements. The use of the relief well injection spool will likely move the additional mud and pump storage challenges from the rig to remotely located support vessels. The support vessels can wait to mobilize closer to the time of relief well intersection. As such, the loading of kill fluid can be performed on an onshore terminal while the relief well is drilled. The relief well injection spool can eliminate the necessity of installing additional pumps and storage tanks on the relief well rig. The relief well injection spool also eliminates the use of boats in close proximity to the relief well. As such, safety concerns in this regard are addressed. The relief well injection spool system is independent of the relief well rig and equipment. Hence, any rig could be chosen for the relief well operation. The relief well injection spool will only require a suitable wellhead and blowout preventer connections that fit the relief well. The relief well injection spool and the additional equipment should be pre-fabricated, maintained, and air freightable so as to enhance the mobilization time. As such, the relief well injection spool is an important tool for well-designed oil spill contingency planning. The present invention ensures that a potential worst-case blowout scenario can be killed with a single relief well.

Typically, the relief well intersection point is as deep as possible, but above the top of the reservoir. This is desirable to achieve a maximum frictional and hydrostatic pressure in the blowing wellbore during the dynamic kill. The relief well injection spool offers benefits on blowouts that do not require a high-rate dynamic-kill rate. Because the relief well injection spool facilitates a higher kill rate than typical relief wells, it may be possible to intersect a blowing well at a shallower depth. Based on the blowout scenario, this can reduce drilling time, eliminate casing strings on the relief well, and, by saving time for a relief-well intervention, it may limit hydrocarbon discharge and pollution from a blowout.

The simulations presented herein illustrate the clear potential for the relief well injection spool to increase the pump capacity to the relief well wellhead significantly. The relief well injection spool can, in some cases, provide a high rate dynamic kill through a single relief well, which otherwise would have only been possible with multiple relief wells. When planning a high-rate dynamic kill operation using the relief well injection spool, the entire relief well configuration and design will need to be optimized. For shallow, prolific wells with low reservoir pressure, the relief well injection spool can be an alternative to drilling two relief wells. Significant benefits for the relief well injection spool are also possible for deepwater blowouts. Relief wells designed to stop a blowout from deepwater wells are restricted by long choke-and-kill lines for pumping. This bottleneck is removed when introducing additional inlets at the wellhead.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We Claim:

1. A well killing system for killing a primary well in which the primary well has a primary wellhead and a wellbore extending to a producing reservoir, the well killing system comprising:

a relief wellbore extending through a seabed so as to open to the primary well, said relief wellbore having a relief wellhead at a seafloor;

a relief well injection spool affixed to said relief wellhead, said relief well injection spool having a body having an internal bore and a pair of inlets opening to said internal bore, each of said pair of inlets having at least one valve thereon so as to selectively open and close the inlet, said relief well injection spool passing a kill fluid only to said relief wellbore and not to the primary wellhead;

a blowout preventer affixed to an end of said relief well injection spool opposite said relief wellhead; and a kill line connected to one of said pair of inlets of said relief well injection spool, said kill line adapted to pass the kill fluid into said relief well injection spool; and a floating vessel connected to said kill line, said floating vessel having a storage tank for the kill fluid and a pump for passing the kill fluid under pressure through said kill line, said kill line comprising a first kill line connected to one of said pair of inlets and a second kill line connected to another of said pair of inlets, said floating vessel comprising:

a first floating vessel connected to said first kill line so as to pass the kill fluid to said one of said pair of inlets; and a second floating vessel connected to said second kill line so as to pass the kill fluid to another of said pair of inlets.

2. The well killing system of claim 1, said relief well injection spool having a ram body cooperative with said internal bore of said relief well injection spool, said ram body adapted to selectively close said internal bore of said relief well injection spool.

3. The well killing system of claim 1, further comprising:

a relief well drilling system connected by pipe to said blowout preventer at an end of said blowout preventer opposite said relief well injection spool.

4. The well killing system of claim 1, said at least one valve comprising:

a first valve cooperative with the inlet so as to selectively open and close the inlet; and a second valve positioned in spaced relation to said first valve and cooperative with the inlet so as to selectively open and close the inlet.

5. The well killing system of claim 1, further comprising:

a manifold connected by said kill line to said one of said pair of inlets of said relief well injection spool, said manifold having the kill fluid therein.

6. A method for killing a well, the method comprising:

forming a primary wellbore to a producing reservoir, the primary wellbore having a wellhead;

forming a relief wellbore extending so as to open to the primary wellbore;

affixing a relief well injection spool to a wellhead of the relief wellbore in which the relief well injection spool has a pair of valved inlets extending to a bore of the relief well injection spool;

moving a floating vessel to a surface location above said relief well injection spool, said floating vessel having a storage tank for the kill fluid and a pump for passing the kill fluid under pressure from said storage tank;

connecting said floating vessel to a line extending to one of said pair of inlets; and pumping the kill fluid under a pressure greater than a pressure of fluids flowing through the primary wellbore from said storage tank to the inlet; and flowing the kill fluid only through the bore of said relief well injection spool and not to the wellhead of the primary wellbore, through said relief wellbore, and to said primary wellbore at a location below the wellhead of said primary wellbore.

* * * * *